US008923736B2

(12) United States Patent
Kim et al.

(10) Patent No.: US 8,923,736 B2
(45) **Date of Patent: *Dec. 30, 2014**

(54) DEVELOPING UNIT AND IMAGE FORMING APPARATUS EMPLOYING THE SAME

(75) Inventors: Jin-hong Kim, Incheon (KR); Joo-hwan Noh, Yongin-si (KR); Young-su Lee, Suwon-si (KR); Yun-kyu Sim, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1067 days.

This patent is subject to a terminal disclaimer.

(21) Appl. No.: 12/926,033

(22) Filed: Oct. 21, 2010

(65) Prior Publication Data

US 2012/0045253 A1 Feb. 23, 2012

(30) Foreign Application Priority Data

Aug. 23, 2010 (KR) ..... 10-2010-0081477

(51) Int. Cl.
*G03G 15/08* (2006.01)

(52) U.S. Cl.
CPC ..... *G03G 15/0896* (2013.01); *G03G 15/0877* (2013.01)
USPC ..... 399/281; 399/279

(58) Field of Classification Search
USPC ..... 399/279, 281
See application file for complete search history.

(56) References Cited

U.S. PATENT DOCUMENTS

| | | | | |
|---|---|---|---|---|
| 5,809,386 | A | 9/1998 | Iwata | |
| 5,903,806 | A * | 5/1999 | Matsuoka et al. | 399/258 |
| 6,343,201 | B1 | 1/2002 | Wada et al. | |
| 2003/0113139 | A1 * | 6/2003 | Yasukawa et al. | 399/281 |
| 2005/0084299 | A1 | 4/2005 | Choi et al. | |
| 2008/0205938 | A1 | 8/2008 | Hirose | |
| 2008/0247784 | A1 | 10/2008 | Kakuta et al. | |
| 2009/0274491 | A1 * | 11/2009 | Sato | 399/281 |
| 2011/0103844 | A1 | 5/2011 | Sato | |
| 2011/0286772 | A1 | 11/2011 | Sato | |
| 2012/0051799 | A1 * | 3/2012 | Kim et al. | 399/281 |
| 2012/0148314 | A1 * | 6/2012 | Park et al. | 399/281 |

FOREIGN PATENT DOCUMENTS

| | | |
|---|---|---|
| EP | 1 318 434 | 6/2003 |
| JP | 2003-173084 | 6/2003 |
| JP | 2008-111998 | 5/2008 |

(Continued)

OTHER PUBLICATIONS

European Search Report issued Mar. 22, 2012 in corresponding European Application No. 11172968.7.

(Continued)

*Primary Examiner* — Walter L Lindsay, Jr.
*Assistant Examiner* — Ruth Labombard
(74) *Attorney, Agent, or Firm* — Staas & Halsey LLP

(57) ABSTRACT

A developing unit includes a toner storage portion containing toner and including a toner supply member, a development portion disposed above the toner storage portion and containing the toner supplied from the toner storage portion by the toner supply member, and including a developing roller and a supply roller to supply the toner to the developing roller, and a partition wall to divide the toner storage portion and the development portion, and including an opening portion disposed under the lowest portion of the supply roller and forming a path of the toner supplied from the toner storage portion to the development portion.

20 Claims, 8 Drawing Sheets

(56) References Cited

FOREIGN PATENT DOCUMENTS

| | | |
|---|---|---|
| JP | 2008-170951 | 7/2008 |
| JP | 2009-265537 | 11/2009 |
| KR | 1999-0053816 | 7/1999 |

OTHER PUBLICATIONS

Korean Non-Final Rejection issued Apr. 27, 2012 in corresponding Korean Application No. 10-2010-0125665.

U.S. Office Action issued May 8, 2014 in corresponding U.S. Appl. No. 13/067,513.

* cited by examiner

DEVELOPING UNIT AND IMAGE FORMING APPARATUS EMPLOYING THE SAME

CROSS-REFERENCE TO RELATED APPLICATIONS

This application claims the benefit of Korean Patent Application No. 10-2010-0081477, filed on Aug. 23, 2010, in the Korean Intellectual Property Office, the disclosure of which is incorporated herein in its entirety by reference.

BACKGROUND

1. Field

Embodiments relate to a developing unit that is detachable from an image forming apparatus, and an image forming apparatus employing the developing unit.

2. Description of the Related Art

In electrophotographic image forming apparatuses, an electrostatic latent image is formed on a surface of a photosensitive body by scanning light that is modulated according to image information onto the photosensitive body, the electrostatic latent image is developed into a visible toner image by supplying toner to the electrostatic latent image, and the toner image is transferred to a recording medium and fused thereto so that an image is printed on the recording medium.

The electrophotographic image forming apparatuses include a developing unit containing a developer. A one-component developing unit contains toner as a developer, whereas a two-component developing unit contains toner and carrier as a developer. When all the developer contained in a developing unit is consumed, the developing unit is detached from an image forming apparatus and a new developing unit is installed in the image forming apparatus.

SUMMARY

To solve the above and/or other problems, provided is a developing unit in which toner is conveyed in the opposite direction to gravity in order to be effectively supplied to a developing roller, and an electrophotographic image forming apparatus employing the developing unit.

Also provided is a developing unit which may reduce a footprint of an image forming apparatus, and an image forming apparatus employing the developing unit.

According to an aspect, a developing unit includes a toner storage portion containing toner and including a toner supply member, a development portion disposed above the toner storage portion and containing the toner supplied from the toner storage portion by the toner supply member, and including a developing roller and a supply roller to supply the toner to the developing roller, and a partition wall to divide the toner storage portion and the development portion, and including an opening portion disposed under the lowest portion of the supply roller and forming a path of the toner supplied from the toner storage portion to the development portion.

At least a part of the opening portion may be overlapped with a vertical projection of the supply roller.

The developing unit may further include an auxiliary supply member disposed between the partition wall and the supply roller and conveying the toner in the development portion to a region where the supply roller and the developing roller face each other.

The auxiliary supply member may be disposed at a downstream of the supply roller with respect to a rotation direction of the developing roller, and the center of the auxiliary supply member may be located between a vertical straight line passing through the center of the developing roller and a vertical straight line passing through the center of the supply roller.

The opening portion may be not overlapped with a vertical projection of the auxiliary supply member.

The developing roller and the supply roller may rotate such that a surface of the developing roller and a surface of the supply roller move in opposite directions in a region where the developing roller and the supply roller face each other. The supply roller and the auxiliary supply member may rotate such that a surface of the supply roller and a surface of the auxiliary supply member move in the same direction in a region where the supply roller and the auxiliary supply member face each other.

The developing roller and the supply roller may rotate such that a surface of the developing roller and a surface of the supply roller move in the opposite directions in a region where the developing roller and the supply roller face each other. The supply roller and the auxiliary supply member may rotate such that a surface of the supply roller and a surface of the auxiliary supply member move in opposite directions in a region where the supply roller and the auxiliary supply member face each other.

The developing unit may further include an auxiliary supply member disposed between the partition wall and the supply roller to convey the toner in the development portion to a region where the supply roller and the developing roller face each other, in which the auxiliary supply member is disposed at a downstream of the supply roller with respect to a rotation direction of the developing roller, and the opening portion is not overlapped with a vertical projection of the auxiliary supply member and at least a part of the opening portion is overlapped with a vertical projection of the developing roller.

The developing roller and the supply roller may rotate such that a surface of the developing roller and a surface of the supply roller move in the opposite directions in a region where the developing roller and the supply roller face each other. The supply roller and the auxiliary supply member may rotate such that a surface of the supply roller and a surface of the auxiliary supply member move in the same direction in a region where the supply roller and the auxiliary supply member face each other. The developing unit may further include a guide member to guide the toner supplied through the region where the supply roller and the auxiliary supply member face each other to proceed to the region where the developing roller and the supply roller face each other.

The auxiliary supply member may rotate in contact with the developing roller. The developing roller and the supply roller may rotate such that a surface of the developing roller and a surface of the supply roller move in opposite directions in a region where the developing roller and the supply roller face each other. The developing roller and the auxiliary supply member may rotate such that a surface of the developing roller and a surface of the auxiliary supply member move in the same direction in a region where the developing roller and the auxiliary supply member face each other.

The toner supply member may include a rotation shaft, and a wing portion having a rotation radius larger than the longest one of distances from the rotation shaft to an inner wall of the toner storage portion and the partition wall, as an elastic member provided at the rotation shaft.

The wing portion may include a body coupled to the rotation shaft, and a first bent portion bent from the body at an acute angle in the rotation direction. The wing portion may include a second bent portion that extends from the first bent portion or the body in the rotation direction and forms with the first bent portion a space for conveying the toner.

According to another aspect, an electrophotographic image forming apparatus includes a photosensitive body, an exposing unit to form an electrostatic latent image on the photosensitive body, a developing unit to develop the electrostatic latent image by supplying toner to the electrostatic latent image, which is defined above, and a fusing unit to fuse a toner image transferred to a recording medium.

The electrophotographic image forming apparatus may further include a plurality of the photosensitive bodies, a plurality of the developing units corresponding to the plurality of photosensitive bodies, an intermediate transfer medium to which toner images formed on the plurality of photosensitive bodies are transferred, and a final transfer unit to transfer the toner images from the intermediate transfer medium to the recording medium, wherein the plurality of developing units comprise the plurality of photosensitive bodies, and the plurality of developing units are disposed under the intermediate transfer medium and the fusing unit is disposed above the intermediate transfer unit.

The exposing unit may be disposed under the plurality of developing units.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION

Figure 1:
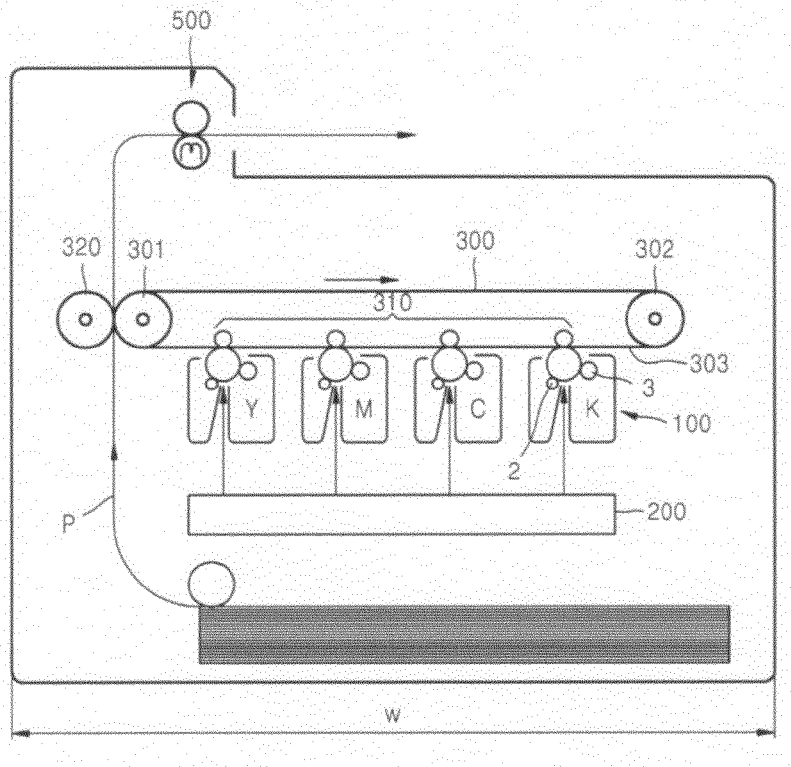
FIG. 1 illustrates a structure of an image forming apparatus according to an embodiment.

Hereinafter, the embodiments will be described in detail by explaining exemplary embodiments of the invention with reference to the attached drawings. Like reference numerals in the drawings denote like elements.

Figure 2:
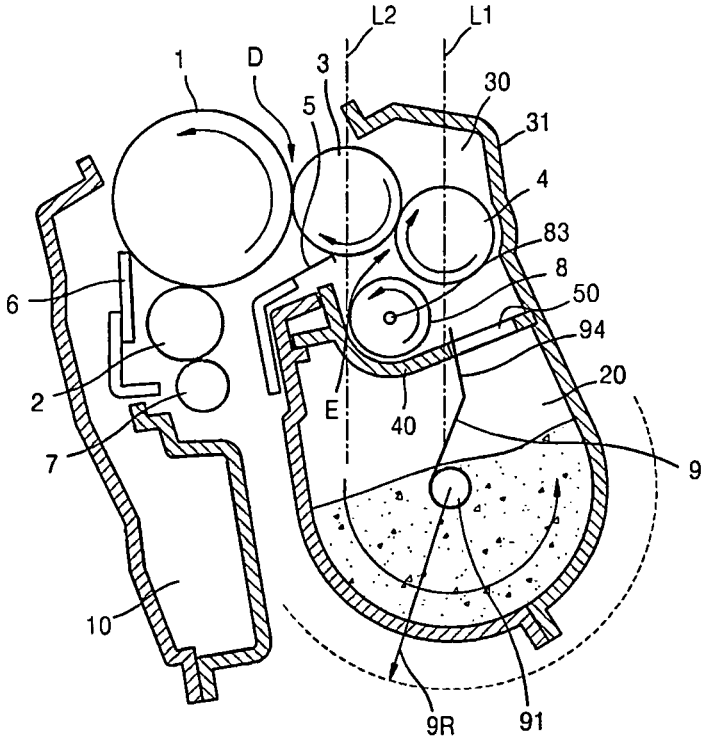
FIG. 2 illustrates a structure of a developing unit according to an embodiment.

FIG. 1 illustrates a structure of an image forming apparatus according to an embodiment. FIG. 2 illustrates a structure of a developing unit employed in the image forming apparatus of FIG. 1. The image forming apparatus according to the present embodiment is a color image forming apparatus for forming a color image with four developing units 100 respectively containing toners of cyan C, magenta M, yellow Y, and black K colors. The color image forming apparatus of FIG. 1 is referred to as a tandem-type color image forming apparatus. In the following descriptions, members used to form an image of cyan C, magenta M, yellow Y, and black K colors are indicated with suffixes of C, M, Y, and K at the end of reference numerals thereof.

Referring to FIG. 1, the image forming apparatus according to the present embodiment includes an intermediate transfer belt 300, an exposing unit 200, the four developing units 100, four intermediate transfer rollers 310, a final transfer roller 320, and a fusing unit 500.

The intermediate transfer belt 300 is an intermediate transfer medium to which a toner image is temporarily transferred before its final transfer to a recording medium P and circulates while being supported by support rollers 301 and 302. Each of the four developing units 100 includes a charge roller 2, a photosensitive drum 1, and developing roller 3. The photosensitive drum 1 is an example of the photosensitive body on which an electrostatic latent image is formed. The photosensitive drum 1 includes a circular metal pipe and a photosensitive layer having a photoconductivity may be formed on an outer circumference of the circular metal pipe. The charge roller 2 is an example of a charger for charging a surface of the photosensitive drum 1 to a uniform electric potential. A corona charging unit may be employed instead of the charge roller 2. The exposing unit 200 scans light modulated according to image information onto the photosensitive drum 1 and thus an electrostatic latent image is formed on the photosensitive drum 1. A light emitting diode (LED)-type expositing unit for selectively emitting LED light according to image information via a plurality of LEDs arranged in a main scanning direction may be used as the exposing unit 200. Also, a laser scanning unit (LSU) for scanning light emitted by a laser diode onto the photosensitive drum 1 by deflecting the light in the main scanning direction with a light deflector may be used as the exposing unit 200. The developing roller 3 allows the toner contained in each of the four developing units 100 to adhere to the electrostatic latent image formed on the photosensitive drum 1, thereby forming a toner image.

The four developing units 100 are arranged such that the photosensitive drum 1 faces a lower surface 303 of the intermediate transfer belt 300. The photosensitive drum 1 may contact the lower surface 303 of the intermediate transfer belt 300. The intermediate transfer rollers 310 are an example of an intermediate transfer unit for transferring the toner image formed on the photosensitive drum 1 to the intermediate transfer belt 300. The four intermediate transfer rollers 310 are located facing the four photosensitive drums 1, with the intermediate transfer belt 300 interposed therebetween. An intermediate transfer bias voltage to transfer the toner image formed on the photosensitive drum 1 to the intermediate transfer belt 300 may be applied to the four intermediate transfer rollers 310. A corona transfer unit may be employed instead of each of the four intermediate transfer rollers 310.

The final transfer roller 320 is an example of a final transfer unit for transferring the toner image on the intermediate transfer belt 300 to the recording medium P. A final transfer bias voltage to transfer the toner image on the intermediate transfer belt 300 to the recording medium P may be applied to the final transfer roller 320. A corona transfer unit may be employed instead of the final transfer roller 320. The fusing unit 500 fuses the toner image transferred to the recording medium P by applying heat and pressure to the toner image.

A color image forming process of the above-described structure will be briefly described below.

First, according to image information of a black K color, the exposing unit 200 scans light onto the photosensitive drum 1K charged to a uniform electric potential by the charge roller 2K, thereby forming an electrostatic latent image. When a development bias is applied to the developing roller 3K of the developing unit 100K, black toner contained in the developing unit 100K adheres to the electrostatic latent image. A black toner image developed on the photosensitive drum 1K is transferred to the intermediate transfer belt 300 by an intermediate bias voltage applied to the intermediate transfer roller 310K. Toner images of cyan, magenta, and yellow colors are transferred to the intermediate transfer belt 300 through the same process and thus a color toner image is formed on the intermediate transfer belt 300. The color toner image is transferred to the recording medium P by a final transfer bias voltage applied to the final transfer roller 320. The color toner image is fused on the recording medium P by the fusing unit 500.

Heat generated by the fusing unit 500 may affect the photosensitive drum 1, the toner contained in the developing unit 100, and the exposing unit 200. Since the intermediate transfer belt 300 is interposed between the fusing unit 500, the developing unit 100, and the exposing unit 200 in the image forming apparatus configured as described above, the developing unit 100, the photosensitive drum 1, and the exposing unit 200 may be less affected by the heat of the fusing unit 500.

In order to increase the toner capacity of the developing unit 100, an internal volume of the developing unit 100 is increased. When the volume of the developing unit 100 is increased in a widthwise direction, the width W of the image forming apparatus is increased so that the footprint of the image forming apparatus is increased. Thus, to increase the toner capacity of the developing unit 100 without increasing the footprint of the image forming apparatus, the developing unit 100 may be increased in a vertical direction, that is, downwardly. In this case, the toner in the developing unit 100 is conveyed in the opposite direction to gravity to be supplied to the developing roller 3.

FIG. 2 illustrates a detailed structure of the developing unit 100 of FIG. 1. Referring to FIG. 2, a cleaning roller 7 is an example of a charge roller cleaning member for removing foreign materials adhered to an outer circumference of the charge roller 2. A cleaning member 6 removes residual toner and foreign materials from a surface of the photosensitive drum 1 before charging. The cleaning member 6 may be, for example, a cleaning blade having a leading end contacting the surface of the photosensitive drum 1. The residual toner and foreign materials removed from the photosensitive drum 1 may be stored in a waste toner containing unit 10.

The developing roller 3 is located facing the photosensitive drum 1. When a contact-type development method is employed, the developing roller 3 may rotate in contact with the photosensitive drum 1. When a non-contact-type development method is employed, the developing roller 3 is arranged separate from the photosensitive drum 1. The interval between the developing roller 3 and the photosensitive drum 1 may be set to be about several tens to several hundreds of microns. A supply roller 4 supplies toner to an outer circumferential surface of the developing roller 3.

A restriction member 5 restricts the amount of toner supplied to a development region D facing the photosensitive drum 1. For example, the restriction member 5 may be a restriction blade that elastically contacts the outer circumferential surface of the developing roller 3.

The developing unit 100 of the present embodiment includes a development portion 30 and a toner storage portion 20. The development portion 30 is located above the toner storage portion 20. The toner is contained in the toner storage portion 20. A toner supply member 9 for supplying the contained toner to the development portion 30 is installed. The development portion 30 and the toner storage portion 20 are divided in a vertical direction by a partition wall 40.

The developing roller 3 and the supply roller 4 are installed in the development portion 30. The supply roller 4 rotates in contact with the developing roller 3 or separately from the developing roller 3 with a predetermined interval. The supply roller 4 supplies the toner contained in the development portion 30 to the developing roller 3.

An opening portion 50 for forming a path through which the toner may be supplied from the toner storage portion 20 to the development portion 30 is provided in the partition wall 40. In order for the opening portion 50 to be located above the lowest portion of the supply roller 4, a right outer wall 31 of the development portion 30 needs to extend to the right in FIG. 2. Then, the width of the developing unit 100 increases so that the overall footprint of the image forming apparatus may be increased. However, to not increase the footprint of the image forming apparatus, the opening portion 50 is located under the lowest portion of the supply roller 4. Also, at least a part of the opening portion 50 is overlapped with a vertical projection of the supply roller 4.

Figure 3:
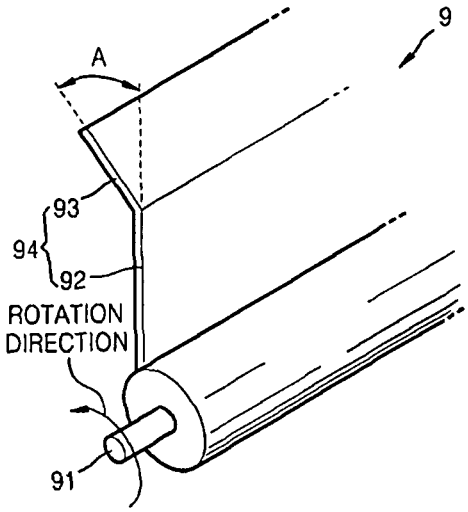
FIG. 3 is a perspective view of a toner supply member according to an embodiment.
Figure 4:
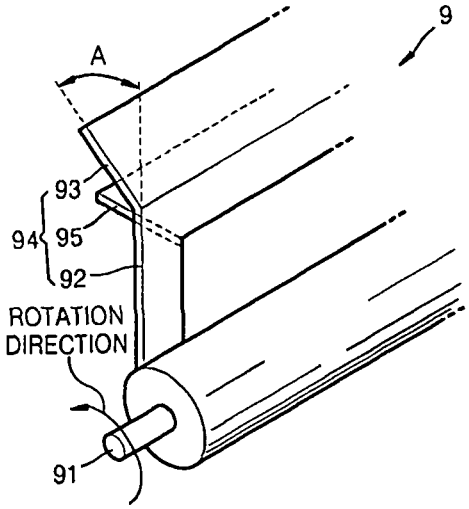
FIG. 4 is a perspective view of a toner supply member according to another embodiment.

The toner supply member 9 may include a rotation shaft 91 and a wing portion 94 formed on the rotation shaft 91 and having elasticity. When the toner supply member 9 rotates, the wing portion 94 elastically contacts a wall portion forming the toner storage portion 20 and conveys toner to the development portion 30 through the opening portion 50. To increase a rate of using toner in the toner storage portion 20, the wing portion 94 is formed with a rotation radius 9R that is larger than the longest one of distances from the rotation shaft 91 to an inner wall of the toner storage portion 20 and the partition wall 40. Accordingly, since an end portion of the wing portion 94 enters in the development portion 30 through the opening portion 50, the toner may be effectively conveyed to the development portion 30. Referring to FIG. 3, the wing portion 94 may include a body 92 and a first bent portion 93 bent at an acute angle "A" from the body 92 in a rotation direction of the wing portion 94. Since the body 92 and the first bent portion 93 form a concave space to convey the toner, the toner may be more effectively conveyed to the development portion 30. Also, referring to FIG. 4, a second bent portion 95 extending from the body 92 in the rotation direction may be further included in the wing portion 94. The second bent portion 95 may extend from the first bent portion 93. Since the second bent portion 95 with the first bent portion 93 forms a concave space to convey the toner, the toner may be conveyed more effectively to the development portion 30. According to the above-described structure, as the toner supply member 9 rotates, the wing portion 94 may elastically contact the wall forming the toner storage portion 20 and supply the toner to the development portion 30 through the opening portion 50.

In the above-described structure, the toner supplied to the development portion 30 may be supplied by the supply roller 4 to the developing roller 3 and may adhere to the outer circumferential surface of the developing roller 3. The supply roller 4 may be rotated in the same direction as the rotation direction of the developing roller 3. That is, the outer circumferential surface of the supply roller 4 and the outer circumferential surface of the developing roller 3 are moved in opposite directions in a region E where the supply roller 4 and the developing roller 3 face each other. Accordingly, with respect to the rotation direction of the developing roller 3, the toner remaining on the surface of the developing roller 3 after passing through a development region D is removed at the upstream side of the region E, and new toner may adhere to the surface of the developing roller 3 in the region E.

Referring to FIG. 2, an auxiliary supply member 8 may be installed in the development portion 30. The auxiliary supply member 8 is located between the partition wall 40 and the supply roller 4 to supply toner to the region E. The auxiliary supply member 8 is located at the downstream side than the supply roller 4 with respect to the rotation direction of the developing roller 3. A rotation center 83 of the auxiliary supply member 8 is located between a vertical straight line L2 passing through the center of the developing roller 3 and a vertical straight line L1 passing through the center of the supply roller 4. The opening portion 50 is not overlapped with a vertical projection of the auxiliary supply member 8. Otherwise, toner falls from the development portion 30 to the toner storage portion 20 through the opening portion 50 so that toner supply performance of the auxiliary supply member 8 may deteriorate.

Toner is supplied from the toner storage portion 20 to the development portion 30 according to a rotation cycle of the toner supply member 9. When the wing portion 94 of the toner supply member 9 pushes the toner into the development portion 30 through the opening portion 50, a toner pressure is applied to the region E. When the wing portion 94 is out of the opening portion 50, the toner pressure in the region E may decrease, and a sufficient amount of toner may not adhere to the developing roller 3. As the auxiliary supply member 8 also applies a toner pressure to the region E, a sufficient amount of toner may be supplied to the developing roller 3.

Figure 5:
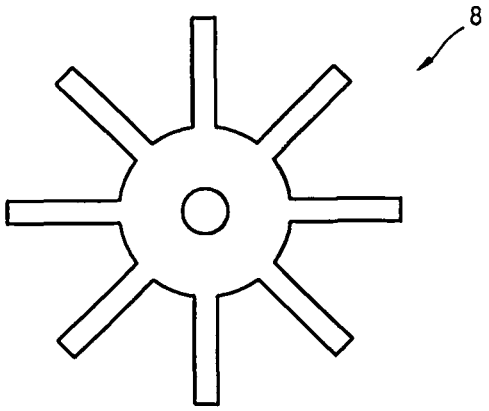
FIG. 5 is a side view of an auxiliary supply member according to an embodiment.
Figure 6:
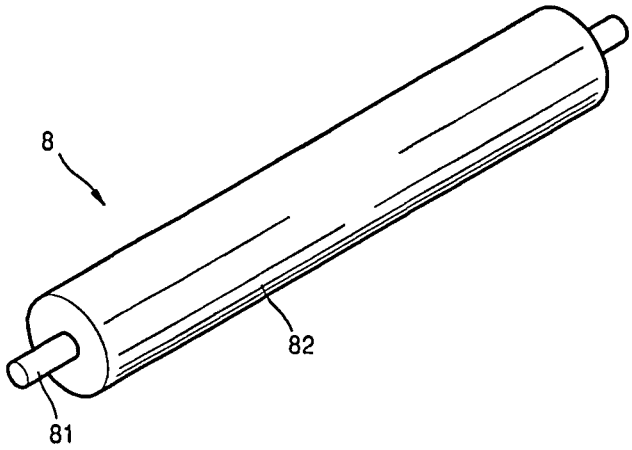
FIG. 6 is a perspective view of an auxiliary supply member according to another embodiment.

The auxiliary supply member 8 may have, for example, a rotary paddle shape, as illustrated in FIG. 5. Also, as illustrated in FIG. 6, the auxiliary supply member 8 may have a roller shape formed of a metal material or a plastic material. In this regard, the auxiliary supply member 8 includes a rotation shaft 81 and a roller portion 82 (see FIG. 6), wherein, the roller portion 82 may be formed of a plastic, metal, or rubber material. The roller portion 82 may have a porous structure such as sponge. Also, a surface of the roller portion 82 may have a surface roughness. The auxiliary supply member 8 may have any shape that may convey toner to the region E.

Figure 7:
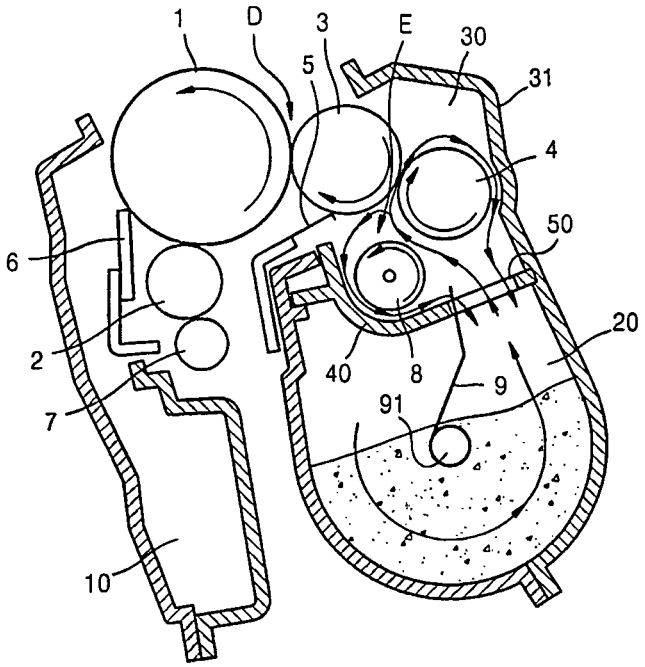
FIG. 7 illustrates a toner circulation process in the developing unit of FIG. 2, according to an embodiment.

The auxiliary supply member 8 rotates in the opposite direction to the rotation direction of the supply roller 4. That is, in a region where the auxiliary supply member 8 and the supply roller 4 face each other, the direction in which the surface of the auxiliary supply member 8 moves is the same as the direction in which the surface of the supply roller 4 moves. According to the above-described structure, as illustrated in FIG. 7, the toner supplied by the toner supply member 9 from the toner storage portion 20 to the development portion 30 is conveyed to the region E between the auxiliary supply member 8 and the supply roller 4 and applies a toner pressure to the region E. The toner that is excessively supplied is removed from the region E through a gap between the auxiliary supply member 8 and the wall 40. Also, the toner removed from the developing roller 3 by the supply roller 4 at the upstream of the region E is removed through a gap between the supply roller 4 and the right outer wall 31. The removed toner falls down to the toner storage portion 20 through the opening portion 50. Thus, an appropriate toner pressure is always maintained in the region E. The toner removed from the region E is mixed with the toner in the toner storage portion 20 and supplied to the development portion 30. As the toner circulates as described above, the toner may be effectively supplied to the developing roller 3 in the opposite direction to gravity. Thus, the developing unit 100 may be enlarged in the gravity direction and the toner capacity of the developing unit 100 may be increased without increasing the dimension of the developing unit 100 in a widthwise direction. In other words, the footprint of the image forming apparatus may be reduced. Also, since the toner may be uniformly and stably supplied to the developing roller 3, uniformity in the quality of an image may be obtained.

Figure 8:
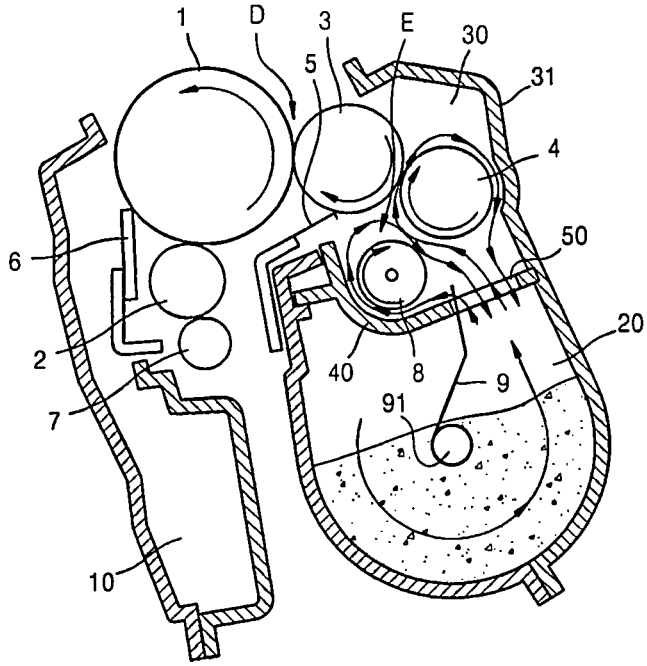
FIG. 8 illustrates a structure of a developing unit according to another embodiment.

FIG. 8 illustrates a structure of a developing unit according to another embodiment of the present invention. Referring to FIG. 8, the auxiliary supply member 8 rotates in the same direction as the rotation direction of the supply roller 4. That is, in the region where the auxiliary supply member 8 and the supply roller 4 face each other, the direction in which the surface of the auxiliary supply member 8 moves is the opposite to the direction in which the surface of the supply roller 4 moves. According to the above-described structure, the toner supplied by the toner supply member 9 from the toner storage portion 20 to the development portion 30 is supplied to the region E through the gap between the auxiliary supply member 8 and the wall 40 and a gap between the auxiliary supply member 8 and the supply roller 4, and applies a toner pressure to the region E. The toner that is excessively supplied is removed from the region E through the gap between the auxiliary supply member 8 and the supply roller 4. Also, the toner removed from the surface of the developing roller 3 by the supply roller 4 at the upstream of the region E is removed through the gap between the supply roller 4 and the right outer wall 31. The removed toner falls down to the toner storage portion 20 through the opening portion 50. Thus, an appropriate toner pressure is always maintained in the region E. The toner removed from the region E is mixed with the toner in the toner storage portion 20 and supplied to the development portion 30. Thus, as the toner circulates as described above, the toner may be effectively and uniformly supplied to the developing roller 3 in the opposite direction to gravity.

Figure 9:
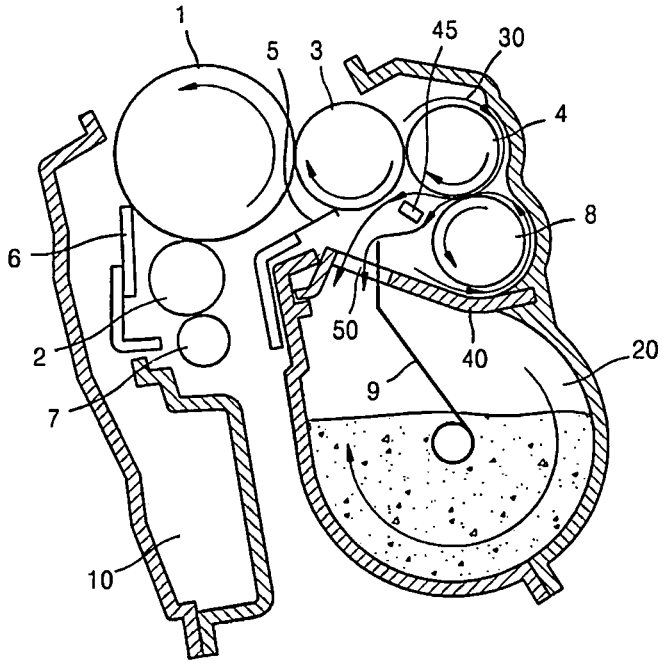
FIG. 9 illustrates a structure of a developing unit according to another embodiment.

FIG. 9 illustrates a structure of a developing unit according to another embodiment of the present invention. Referring to FIG. 9, the location of the opening portion 50 is different from that of the opening portion 50 in FIGS. 2 and 8. The opening portion 50 is not overlapped with the vertical projection of the auxiliary supply member 8 and at least a part of the opening portion 50 is overlapped with a vertical projection of the developing roller 3. Also, considering the location of the opening portion 50, the shape and the rotation direction of the toner supply member 9 is symmetrical and opposite, respectively, to those of the toner supply member 9 of FIGS. 2 and 8.

Also, the auxiliary supply member 8 rotates in the opposite direction to the rotation direction of the supply roller 4. In the region where the auxiliary supply member 8 and the supply roller 4 face each other, the direction in which the surface of the auxiliary supply member 8 moves is the same as the direction in which the surface of the supply roller 4 moves. The supply roller 4 and the auxiliary supply member 8 rotate in a direction in which the toner supplied from the toner storage portion 20 is transferred into the development portion 30 so that a toner pressure is applied to the region E.

According to the above-described structure, the toner supplied by the toner supply member 9 from the toner storage portion 20 to the development portion 30 is supplied to the region E by the auxiliary supply member 8. Also, the toner is supplied to the region E through the gap between the auxiliary supply member 8 and the partition wall 40. The toner that is excessively supplied falls down to the toner storage portion 20 through the opening portion 50. The toner removed from the surface of the developing roller 3 by the supply roller 4 at the upstream of the region E is conveyed through the gap between the supply roller 4 and the right outer wall 31 and falls down to the toner storage portion 20 through the opening portion 50. As the toner circulates as described above, the toner may be effectively and uniformly supplied to the developing roller 3 in the opposite direction to gravity.

Referring to FIG. 9, a guide member 45 may be provided under the supply roller 4 at a position separate from the partition wall 40. The guide member 45 prevents the toner conveyed through the gap between the partition wall 40 and the auxiliary supply member 8 and the gap between supply roller 4 and the auxiliary supply member 8 from falling down due to its own weight and guides the toner to proceed toward the region E. Thus, the toner may be effectively supplied to the region E.

Figure 10:
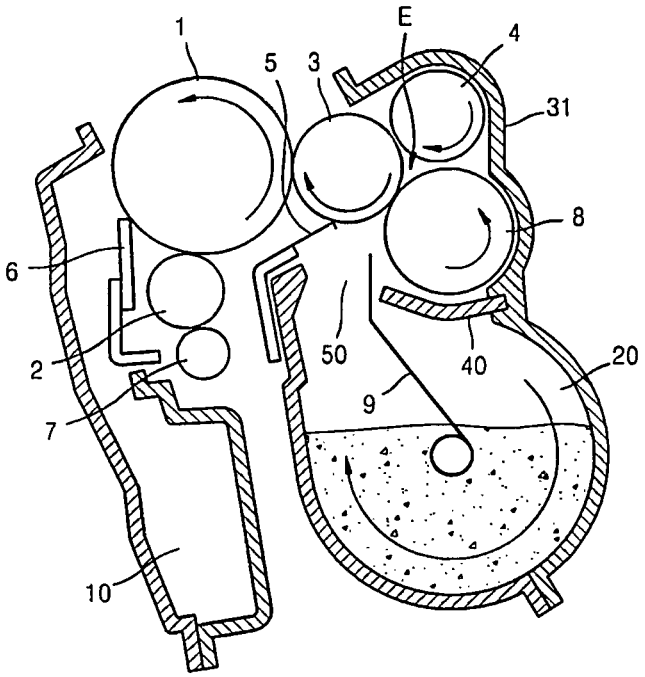
FIG. 10 illustrates a structure of a developing unit according to another embodiment.

FIG. 10 illustrates a structure of a developing unit according to another embodiment of the present invention. Referring to FIG. 10, the developing unit according to the present embodiment is different from that of FIG. 9 in that the auxiliary supply member 8 rotates in contact with the developing roller 3. The rotation direction of the auxiliary supply member 8 is opposite to that of the developing roller 3. That is, the direction in which the surface of the auxiliary supply member 8 moves is the same as the direction in which the surface of the developing roller 3 moves in a region where the auxiliary supply member 8 faces the developing roller 3. In this case, the auxiliary supply member 8 is formed of a material that does not damage the surface of the developing roller 3.

According to the above-described structure, since the region E is encompassed by the developing roller 3, the supply roller 4, and the auxiliary supply member 8, a toner pressure in the region E may be easily maintained constant. Also, since the auxiliary supply member 8 rotates in contact with the developing roller 3, a sufficient amount of toner may be supplied to the surface of the developing roller 3.

According to the developing unit according to the embodiments and the image forming apparatus employing the developing unit, the following effects may be obtained.

First, since toner is effectively and uniformly conveyed in the opposite direction to gravity, uniform image quality may be obtained.

Second, by decreasing the dimension of the developing unit in a widthwise direction, the footprint of the image forming apparatus may be reduced.

Third, since toner circulates between the development portion and the toner storage portion arranged in a vertical direction, stagnation of the toner in the toner storage portion and the development portion may be prevented.

While this invention has been particularly shown and described with reference to exemplary embodiments thereof, it will be understood by those skilled in the art that various changes in form and details may be made therein without departing from the spirit and scope of the invention as defined by the appended claims.

What is claimed is:

1. A developing unit comprising:

a toner storage portion containing toner and comprising a toner supply member;

a development portion disposed above the toner storage portion and containing the toner supplied from the toner storage portion by the toner supply member, and comprising a developing roller and a supply roller to supply the toner to the developing roller; and a partition wall to divide the toner storage portion and the development portion, and including an opening portion disposed under the lowest portion of the supply roller to form a path of the toner supplied from the toner storage portion to the development portion.

2. The developing unit of claim 1, wherein at least a part of the opening portion is overlapped with a vertical projection of the supply roller.

3. The developing unit of claim 2, further comprising an auxiliary supply member disposed between the partition wall and the supply roller to convey the toner in the development portion to a region where the supply roller and the developing roller face each other.

4. The developing unit of claim 3, wherein the auxiliary supply member is disposed at a downstream of the supply roller with respect to a rotation direction of the developing roller, and the center of the auxiliary supply member is located between a vertical straight line passing through the center of the developing roller and a vertical straight line passing through the center of the supply roller.

5. The developing unit of claim 4, wherein the opening portion is not overlapped with a vertical projection of the auxiliary supply member.

6. The developing unit of claim 5, wherein the developing roller and the supply roller rotate such that a surface of the developing roller and a surface of the supply roller move in opposite directions in a region where the developing roller and the supply roller face each other, and the supply roller and the auxiliary supply member rotate such that a surface of the supply roller and a surface of the auxiliary supply member move in the same direction in a region where the supply roller and the auxiliary supply member face each other.

7. The developing unit of claim 5, wherein the developing roller and the supply roller rotate such that a surface of the developing roller and a surface of the supply roller move in the opposite directions in a region where the developing roller and the supply roller face each other, and the supply roller and the auxiliary supply member rotate such that a surface of the supply roller and a surface of the auxiliary supply member move in opposite directions in a region where the supply roller and the auxiliary supply member face each other.

8. The developing unit of claim 1, further comprising an auxiliary supply member disposed between the partition wall and the supply roller and conveying the toner in the development portion to a region where the supply roller and the developing roller face each other, wherein the auxiliary supply member is disposed at a downstream of the supply roller with respect to a rotation direction of the developing roller, and the opening portion is not overlapped with a vertical projection of the auxiliary supply member and at least a part of the opening portion is overlapped with a vertical projection of the developing roller.

9. The developing unit of claim 8, wherein the developing roller and the supply roller rotate such that a surface of the developing roller and a surface of the supply roller move in the opposite directions in a region where the developing roller and the supply roller face each other, and the supply roller and the auxiliary supply member rotate such that a surface of the supply roller and a surface of the auxiliary supply member move in the same direction in a region where the supply roller and the auxiliary supply member face each other.

10. The developing unit of claim 9, further comprising a guide member to guide the toner supplied through the region where the supply roller and the auxiliary supply member face each other to proceed to the region where the developing roller and the supply roller face each other.

11. The developing unit of claim 8, wherein the auxiliary supply member rotates in contact with the developing roller.

12. The developing unit of claim 11, wherein the developing roller and the supply roller rotate such that a surface of the developing roller and a surface of the supply roller move in opposite directions in a region where the developing roller and the supply roller face each other, and the developing roller and the auxiliary supply member rotate such that a surface of the developing roller and a surface of the auxiliary supply member move in the same direction in a region where the developing roller and the auxiliary supply member face each other.

13. The developing unit of claim 1, wherein the toner supply member comprises:

a rotation shaft; and a wing portion having a rotation radius larger than the longest one of distances from the rotation shaft to an inner wall of the toner storage portion and the partition wall, as an elastic member provided at the rotation shaft.

14. The developing unit of claim 13, wherein the wing portion comprises:

a body coupled to the rotation shaft; and a first bent portion bent from the body at an acute angle in the rotation direction.

15. The developing unit of claim 14, wherein the wing portion comprises a second bent portion that extends from the first bent portion or the body in the rotation direction and forms with the first bent portion a space to convey the toner.

16. An electrophotographic image forming apparatus comprising:

a photosensitive body;

an exposing unit to form an electrostatic latent image on the photosensitive body;

a developing unit to develop the electrostatic latent image by supplying toner to the electrostatic latent image, which is defined in claim 1; and a fusing unit to fuse a toner image transferred to a recording medium.

17. The electrophotographic image forming apparatus of claim 16, wherein at least a part of the opening portion is overlapped with a vertical footprint of the supply roller.

18. The electrophotographic image forming apparatus of claim 17, further comprising an auxiliary supply member disposed between the partition wall and the supply roller and conveying the toner in the development portion to a region where the supply roller and the developing roller face each other, wherein the auxiliary supply member is disposed at a downstream of the supply roller with respect to a rotation direction of the developing roller, and the center of the auxiliary supply member is located between a vertical straight line passing through the center of the developing roller and a vertical straight line passing through the center of the supply roller.

19. The electrophotographic image forming apparatus of claim 16, further comprising:

a plurality of the photosensitive bodies;

a plurality of the developing units corresponding to the plurality of photosensitive bodies;

an intermediate transfer medium to which toner images formed on the plurality of photosensitive bodies are transferred; and a final transfer unit for transferring the toner images from the intermediate transfer medium to the recording medium, wherein the plurality of developing units comprise the plurality of photosensitive bodies, and the plurality of developing units are disposed under the intermediate transfer medium and the fusing unit is disposed above the intermediate transfer medium.

20. The electrophotographic image forming apparatus of claim 19, wherein the exposing unit is disposed under the plurality of developing units.

* * * * *